US008723850B2

(12) United States Patent
Yang et al.

(10) Patent No.: US 8,723,850 B2
(45) Date of Patent: May 13, 2014

(54) METHOD OF PROGRAMMING DRIVING WAVEFORM FOR ELECTROPHORETIC DISPLAY

(75) Inventors: Chang-Jing Yang, Taoyuan Hsien (TW); Jau-Shiu Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 108 days.

(21) Appl. No.: 13/562,518

(22) Filed: Jul. 31, 2012

(65) Prior Publication Data

US 2013/0033472 A1 Feb. 7, 2013

Related U.S. Application Data

(60) Provisional application No. 61/513,942, filed on Aug. 1, 2011.

(51) Int. Cl.
*G09G 5/00* (2006.01)
*G09G 3/34* (2006.01)

(52) U.S. Cl.
USPC ..... 345/208; 345/107; 359/296

(58) Field of Classification Search
CPC ..... G02F 1/167; G09G 3/344; G09G 3/3446; G09G 2310/0243; G02B 26/026
USPC ..... 345/107, 204, 690, 208–210; 359/296
See application file for complete search history.

(56) References Cited

U.S. PATENT DOCUMENTS

| | | | | |
|---|---|---|---|---|
| 7,050,040 | B2 * | 5/2006 | Daniel et al. | 345/107 |
| 7,924,412 | B2 * | 4/2011 | Chopra et al. | 356/72 |
| 8,576,145 | B2 * | 11/2013 | Miller et al. | 345/76 |
| 2003/0137521 | A1 * | 7/2003 | Zehner et al. | 345/589 |
| 2007/0091091 | A1 * | 4/2007 | Gardiner et al. | 345/440 |
| 2011/0285730 | A1 * | 11/2011 | Lai et al. | 345/536 |

* cited by examiner

*Primary Examiner* — Stephen Sherman
(74) *Attorney, Agent, or Firm* — Muncy, Geissler, Olds & Lowe, P.C.

(57) ABSTRACT

A method of programming a driving waveform for an electrophoretic display (EPD) is provided, wherein the driving waveform includes several single pulses selected from K candidate pulse widths $W_1$~$W_K$. First, K different constant pulse sequences corresponding to $W_1$~$W_K$ may be applied to the EPD, to obtain K sets of discrete electro-optical response data. A polynomial curve fitting algorithm is applied to obtain K relation curves $C_1$~$C_K$ between contrast ratios of the EPD to time, corresponding to the K sets of discrete electro-optical response data. After calculating the slope values $S_1$~$S_K$ of the curves $C_1$~$C_K$ at a current contrast ratio of the EPD, a maximum slope $S_{max}$ among $S_1$~$S_K$ and a specific pulse width $W_S$ corresponding thereto are determined. A next contrast ratio of the EPD is calculated according to $W_S$ and $S_{max}$. The design process is repeated until the next contrast ratio of the EPD exceeds a target value.

9 Claims, 3 Drawing Sheets

METHOD OF PROGRAMMING DRIVING WAVEFORM FOR ELECTROPHORETIC DISPLAY

CROSS REFERENCE TO RELATED APPLICATIONS

This application claims the benefit of U.S. Provisional Application No. 61/513,942, filed 1 Aug. 2011, the entirety of which is/are incorporated by reference herein.

BACKGROUND OF THE INVENTION

1. Field of the Invention

This application relates in general to a method of programming a driving waveform, and in particular to a method of programming a driving waveform for electrophoretic displays (EPDs).

2. Description of the Related Art

Quick-response liquid powder displays (QR-LPDs) have remarkable advantages of a clear threshold and fast response time, but also have a major drawback of a low optical contrast ratio. Various conventional driving methods can be applied for driving the QR-LPDs, such as pulse number modulation (PNM). However, the conventional driving methods usually require a long driving duration. Thus, to provide a programmed driving waveform in considering the trade-off between image contrast and driving duration has become a big challenge.

BRIEF SUMMARY OF INVENTION

An object of the application is to provide a method of programming a driving waveform for an electrophoretic display (EPD), wherein the driving waveform includes a plurality of single pulses selected from K candidate pulse widths $W_1$~$W_K$. First, K different constant pulse sequences corresponding to the K candidate pulse widths $W_1$~$W_K$ may be applied to the EPD, so as to obtain K sets of discrete electro-optical response data. A polynomial curve fitting algorithm is then applied to obtain K relation curves $C_1$~$C_K$ between contrast ratios of the EPD to time, corresponding to the K sets of discrete electro-optical response data. After calculating the slope values $S_1$~$S_K$ of the K relation curves $C_1$~$C_K$ at a current contrast ratio of the EPD, a maximum slope $S_{max}$ among the slope values $S_1$~$S_K$ and a specific pulse width $W_S$ corresponding to the maximum slope $S_{max}$ can be determined. A next contrast ratio of the EPD is then calculated according to the specific pulse width $W_S$ and the maximum slope $S_{max}$. The design process can be repeated until the next contrast ratio of the EPD exceeds a target value.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1:
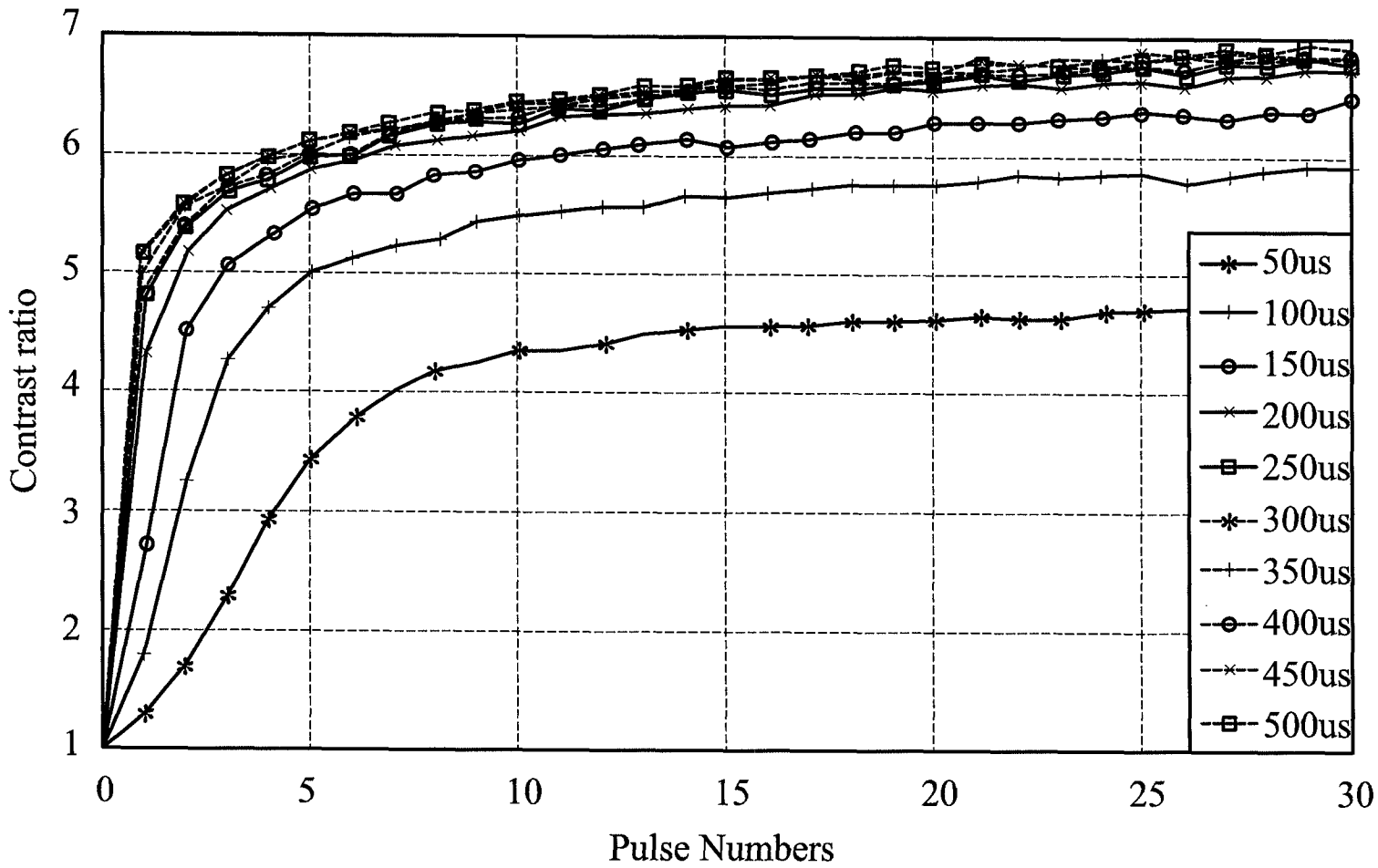
FIG. 1 is a diagram showing optical responses of a QR-LPD driven by different PNM signals with pulse widths from 50 μs to 500 μs.

FIG. 1 shows optical responses of a QR-LPD driven by different PNM signals with pulse widths from 50 μs to 500 μs. To simplify system hardware and reduce power consumption, a relative high voltage of 70 V is employed, and the PNM signals have an equivalent interval 150 μs between each single pulse. For example, when applying a driving waveform with a pulse width of 400 μs, the contrast ratio of the QR-LPD can exceed 6 within 5 pulses.

In this embodiment, PNM signals can be applied to obtain higher optical contrast of the QR-LPD. Meanwhile, the duration of the driving waveform increases along with the number of pulses, such that the balance between the optical contrast and the image updating speed becomes a trade-off and thus requires careful consideration.

Referring to FIG. 1, a trend that when the first pulse of the driving waveform has a larger pulse width, the QR-LPD can achieve a relative higher optical contrast value. It is noted that the following pulses do not yield an obvious increase in optical contrast if the same algorithm is employed. Thus, an efficient method of combination of different pulse widths for the driving waveform may be applied, so as to reduce the driving duration and achieve high optical contrast.

As described above, a programmed driving waveform can be proposed for the QR-LPD, so as to minimize the duration of the driving waveform while also maintaining the optical contrast. The problem can be formulated as follow:

$$\mathrm{Min}D = \mathrm{Min}\sum_{i=1}^{N} d(i)$$

$$Suject\ \mathrm{to}\ \sum_{i=1}^{N} \Delta c(i) \geq c_{req}$$

The driving waveform in the formula is composed of N periods consisting of a pulse and an interval. Here, d(i) is the i-th period, and D is the duration of the driving waveform. The increase in optical contrast for the QR-LPD driven by each period d(i) is represented as Δc(i), and the optical contrast achieved by using the duration D should be the required optical contrast $c_{req}$.

Figure 2:
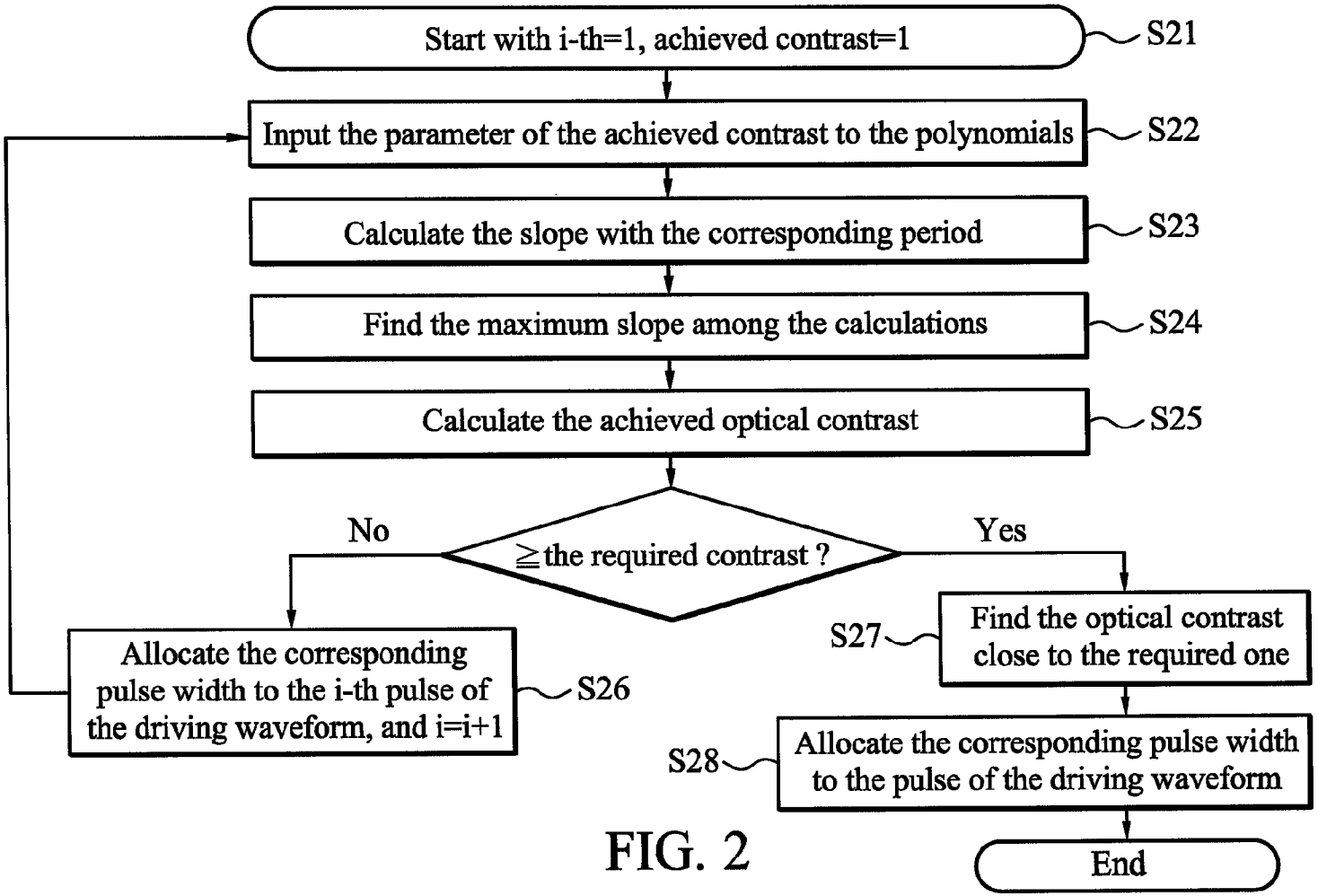
FIG. 2 illustrates a design process for programming a driving waveform according to an embodiment of the invention.

FIG. 2 shows a design process for programming a driving waveform according to an embodiment of the invention. The design process begins with the step S21, allocation of the pulse width of the first period of the waveform. The slope of the increased contrast of the i-th period is calculated by using Δc(i)/d(i), which can be simply obtained as a polynomial as shown in the steps S22~S23. Of the calculated polynomials, the candidate having the pulse width with the maximum slope is allocated to the i-th period as shown in the steps S24~S25. Next, on the basis of the contrast achieved in the i-th period, the slope of the increased contrast is calculated again, and the pulse width corresponding to the maximum slope is allocated to the (i+1)-th period as shown in the step S26. The loop from the step S22 to the step S26 shown in FIG. 2 can be repeated until the achieved optical contrast exceeds a target value or the required contrast as shown in the steps S27~S28 and will be described later.

Based on the design process shown in FIG. 2, a method of programming a driving waveform for an electrophoretic display (EPD) is provided, wherein the driving waveform includes a plurality of single pulses selected from K candidate pulse widths $W_1$~$W_K$. The first is to obtain K sets of discrete electro-optical response data by respectively applying K different constant pulse sequences to the EPD, wherein the K different constant pulse sequences respectively correspond to the K candidate pulse widths $W_1$~$W_K$. In an exemplary embodiment, 10 PNM signals with 10 different pulse widths increasing from 50 μs to 500 μs may be applied to the QR-LPD (K=10), such as the electro-optical response data shown in FIG. 1. Subsequently, a polynomial curve fitting algorithm can be applied to obtain K relation curves $C_1$~$C_K$ between contrast ratios of the EPD to time, wherein the K relation curves $C_1$~$C_K$ respectively correspond to the K sets of discrete electro-optical response data. In some embodiments, a fifth-order 2D polynomial may be used for least-square-based curve fitting as the polynomial curve fitting algorithm.

When the polynomial curves corresponding to the K sets of discrete electro-optical response data are established, K slope values $S_1$~$S_K$ of the K relation curves $C_1$~$C_K$ at a current contrast ratio of the EPD can be respectively calculated. The next is to select a maximum slope $S_{max}$ among the K slope values $S_1$~$S_K$ and determine a specific pulse width $W_S$ among the K candidate pulse widths $W_1$~$W_K$, corresponding to the maximum slope $S_{max}$. Therefore, a next contrast ratio of the EPD can be calculated according to the specific pulse width $W_S$ and the maximum slope $S_{max}$. The aforesaid calculating algorithm can be repeated several times until the next contrast ratio of the EPD exceeds a target value, such as the loop from the step S22 to the step S26 shown in FIG. 2.

It is further noted that the specific pulse width $W_S$ may be replaced by another pulse width selected from the K candidate pulse widths $W_1$~$W_K$ when the next contrast ratio of the EPD exceeds the target value. As the steps S27~S28 shown in FIG. 2, when the next contrast ratio of the EPD exceeds the target value, a new contrast ratio of the EPD less than and close to the target value can be found based on the K candidate pulse widths $W_1$~$W_K$, and the reselected pulse width corresponding to the newly selected contrast ratio of the EPD can be allocated to the pulse of the driving waveform.

Figure 3:
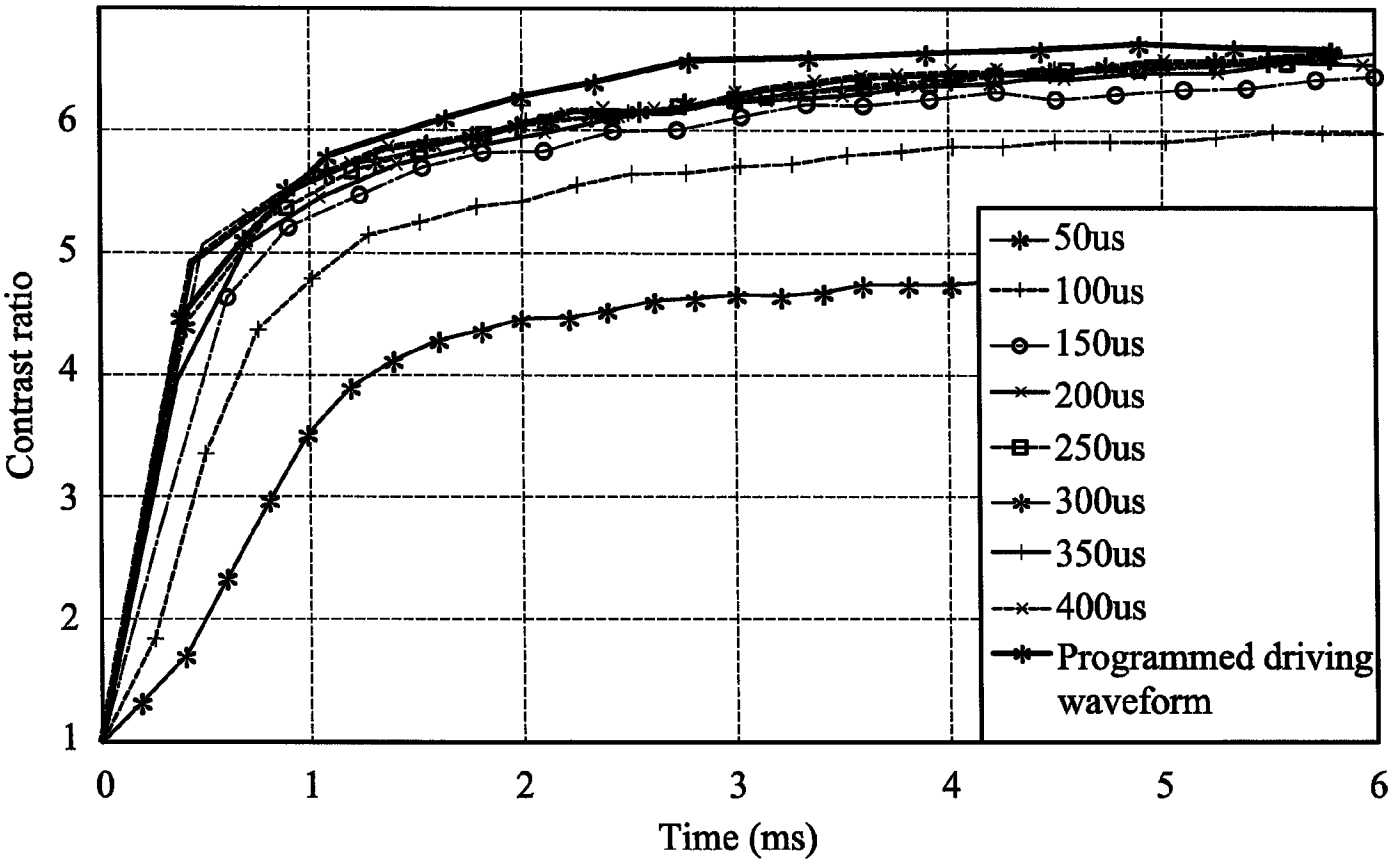
FIG. 3 is a diagram showing the performances of a programmed PNM driving waveform with different pulse widths and several PNM signals with a fixed pulse width.

FIG. 3 shows the performances of a programmed PNM driving waveform with different pulse widths and the conventional PNM signals with a fixed pulse width. Within a duration of 6 ms, the driving waveforms with consecutive periods having pulse widths less than 100 μs yield poor optical contrast (less than 6). Moreover, the optical contrast of the curves will converge to an approximate value if the pulse width of the consecutive periods in the driving waveform is larger than 150 μs. In terms of the trade-off between the optical contrast and the image update speed, an optical contrast greater than 6 requires a disproportionately long driving duration (more than 2~3 ms). As shown in FIG. 3, the duration of the programmed driving waveform corresponding to the target value 6 needs only about 1.5 ms or less, which is 28% to 36.5% shorter than that of the conventional method.

The invention provides a method of programming a driving waveform for an electrophoretic display (EPD), such as QR-LPD or the like. The programmed driving waveform can be obtained by the design process as shown in FIG. 2, wherein the driving waveform may comprise a plurality of pulses with different pulse widths to achieve a shorter driving duration and higher optical contrast.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A method of programming a driving waveform for an electrophoretic display (EPD), wherein the driving waveform includes a plurality of single pulses selected from K candidate pulse widths $W_1$~$W_K$, comprising steps of:

(a) obtaining K sets of discrete electro-optical response data by respectively applying K different constant pulse sequences to the EPD, wherein the K different constant pulse sequences respectively correspond to the K candidate pulse widths $W_1$~$W_K$;

(b) applying a polynomial curve fitting algorithm to obtain K relation curves $C_1$~$C_K$ between contrast ratios of the EPD to time, wherein the K relation curves $C_1$~$C_K$ respectively correspond to the K sets of discrete electro-optical response data;

(c) calculating K slope values $S_1$~$S_K$ of the K relation curves $C_1$~$C_K$ at a current contrast ratio of the EPD;

(d) selecting a maximum slope $S_{max}$ among the K slope values $S_1$~$S_K$ and determining a specific pulse width $W_S$ among the K candidate pulse widths $W_1$~$W_K$ corresponding to the maximum slope $S_{max}$;

(e) calculating a next contrast ratio of the EPD according to the specific pulse width $W_S$ and the maximum slope $S_{max}$; and (f) repeating the steps (c) to (e) until the next contrast ratio of the EPD exceeds a target value.

2. The method as claimed in claim 1, wherein the specific pulse width $W_S$ is replaced by another pulse width selected from the K candidate pulse widths $W_1$~$W_K$ when the next contrast ratio of the EPD exceeds the target value.

3. The method as claimed in claim 1, wherein a fifth-order 2D polynomial is used for least-square-based curve fitting as the polynomial curve fitting algorithm in the step (b).

4. The method as claimed in claim 1, wherein the EPD is driven by a pulse number modulation (PNM) signal.

5. The method as claimed in claim 1, wherein the EPD is a Quick-response liquid powder display (QR-LPD).

6. The method as claimed in claim 1, wherein all the single pulses of the driving waveform have the same relative voltage.

7. The method as claimed in claim 1, wherein the K candidate pulse widths $W_1$~$W_K$ are in a range between 50~500 μs.

8. The method as claimed in claim 1, wherein the driving waveform further comprises a plurality of constant intervals between the single pulses.

9. The method as claimed in claim 8, wherein the constant intervals are about 150μs.

* * * * *